US005607229A

United States Patent [19]

Rykowski et al.

[11] Patent Number: 5,607,229

[45] Date of Patent: Mar. 4, 1997

[54] ILLUMINATION SYSTEM INCLUDING AN ASYMMETRICAL PROJECTION REFLECTOR

[75] Inventors: Ronald F. Rykowski, Woodinville, Wash.; Steven S. Wilson, San Juan Capistrano, Calif.

[73] Assignee: Radiant Imaging Inc., San Juan Capistrano, Calif.

[21] Appl. No.: 415,424

[22] Filed: Apr. 3, 1995

[51] Int. Cl.[6] ..... F21V 7/00

[52] U.S. Cl. ..... 362/346; 362/297

[58] Field of Search ..... 362/346, 347, 362/350, 297

[56] References Cited

U.S. PATENT DOCUMENTS

| | | | |
|---|---|---|---|
| 4,149,227 | 4/1979 | Dorman | 362/297 |
| 4,171,874 | 10/1979 | Bigelow et al. | 350/345 |
| 4,428,038 | 1/1984 | Rakitsch et al. | 362/346 |
| 4,735,495 | 4/1988 | Henkes | 350/345 |
| 4,855,886 | 8/1989 | Eijkelenboom et al. | 362/350 |
| 5,008,781 | 4/1991 | Nino | 362/346 |
| 5,047,903 | 9/1991 | Choji | 362/346 |
| 5,123,729 | 6/1992 | Kondo et al. | 353/99 |
| 5,142,387 | 8/1992 | Shikama et al. | 359/49 |
| 5,150,138 | 9/1992 | Nakanishi et al. | 353/38 |
| 5,295,005 | 3/1994 | Nishida et al. | 359/41 |

FOREIGN PATENT DOCUMENTS

| | | | |
|---|---|---|---|
| 13058 | 2/1915 | United Kingdom | 362/346 |

*Primary Examiner*—Ira S. Lazarus
*Assistant Examiner*—Sara Sachie Raab

[57] ABSTRACT

An illumination system for providing higher efficiency and greater control over uniformity of illumination of non-circular apertures, which are commonly rectangular. The illumination system comprises a reflector of substantially ellipsoidal form surrounding a light source, and which has a concave reflection surface formed of a plurality of curved reflective segments extending along the length of the reflection surface, each of which is tilted and rotated by a predetermined amount to direct light from the reflector almost entirely into the area encompassed by the rectangular aperture including portions of the area which lie outside of a circular area inscribed within the aperture.

9 Claims, 3 Drawing Sheets

FIG. 1 PRIOR ART
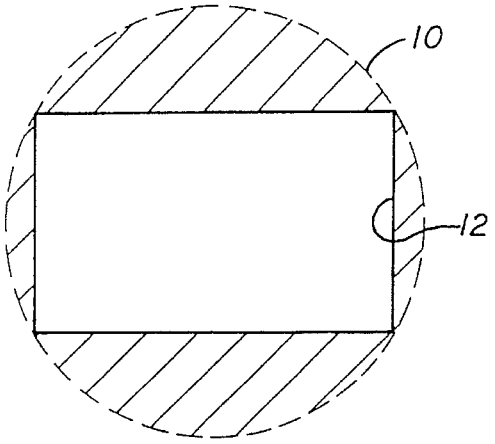
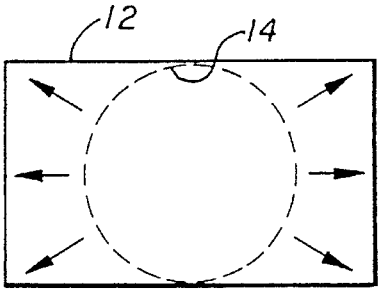
FIG. 2
FIG. 3
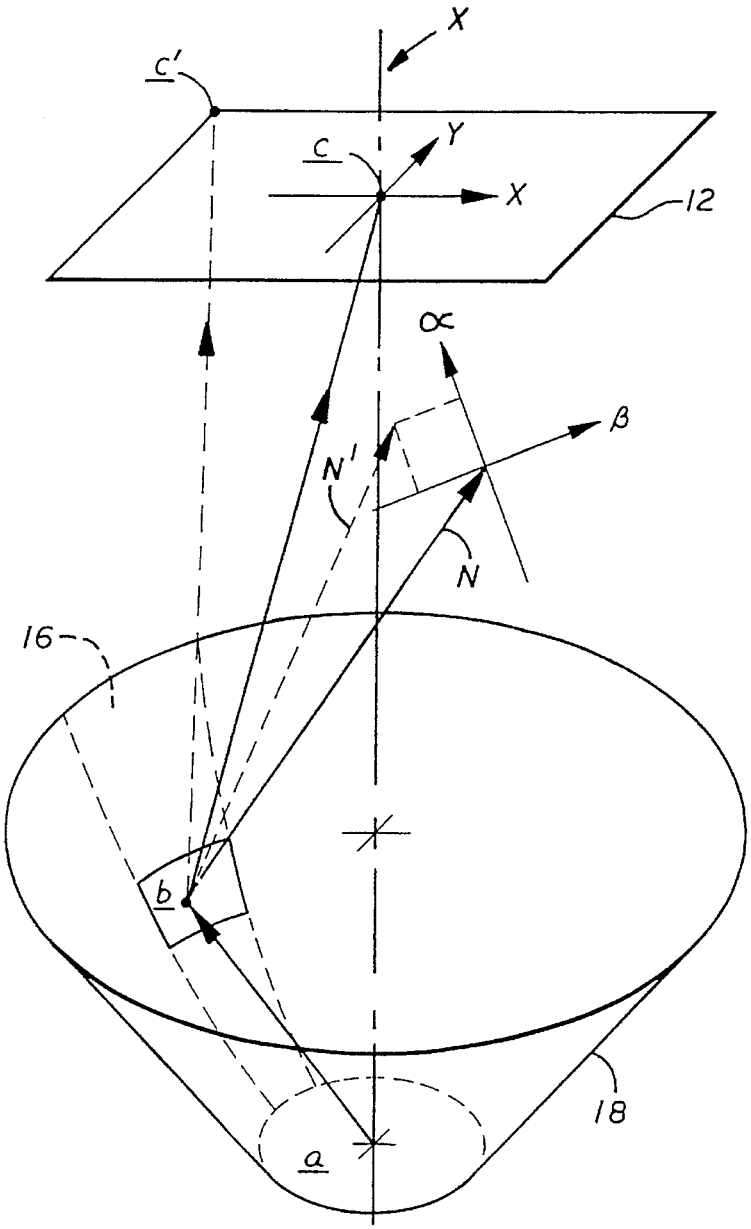

FIG. 4
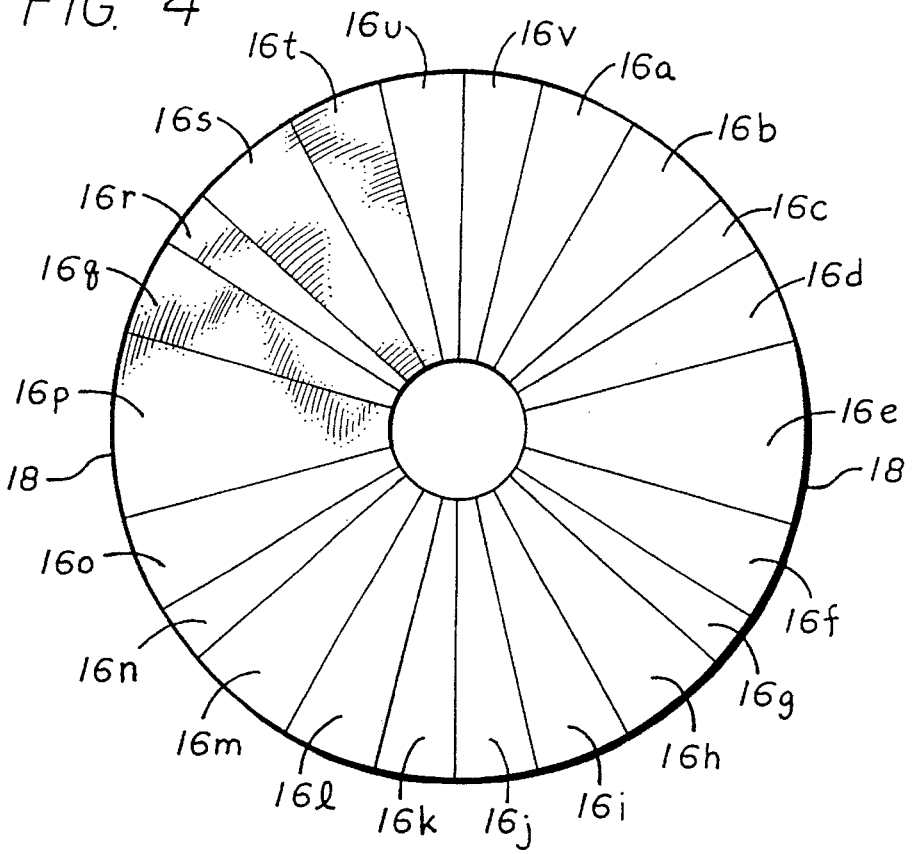
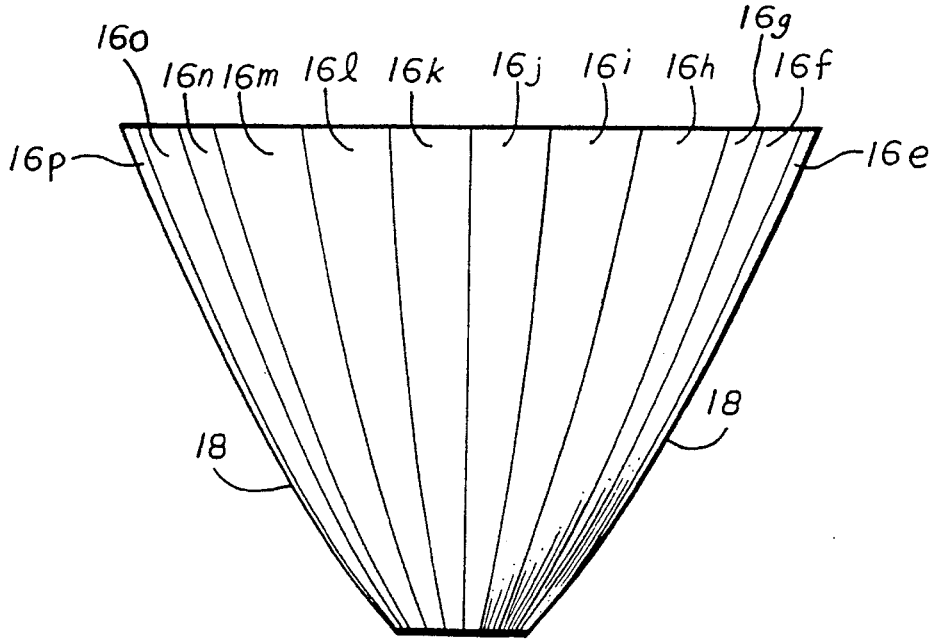
FIG. 5

FIG. 6
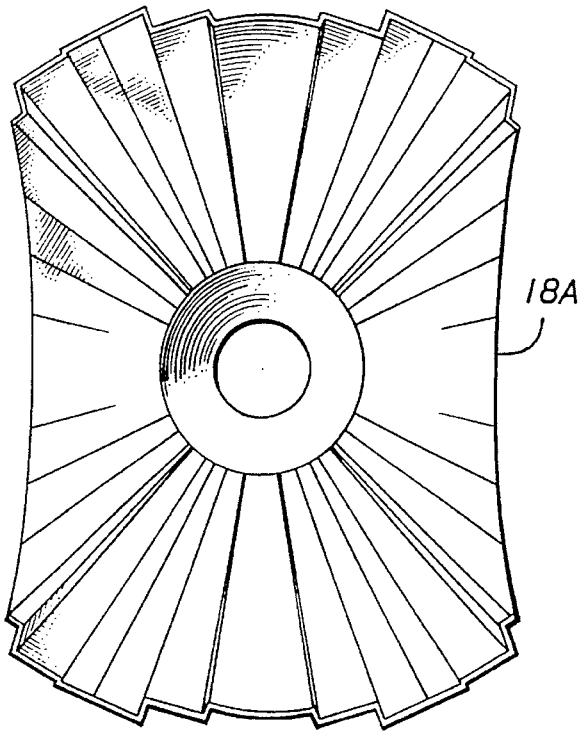
FIG. 7
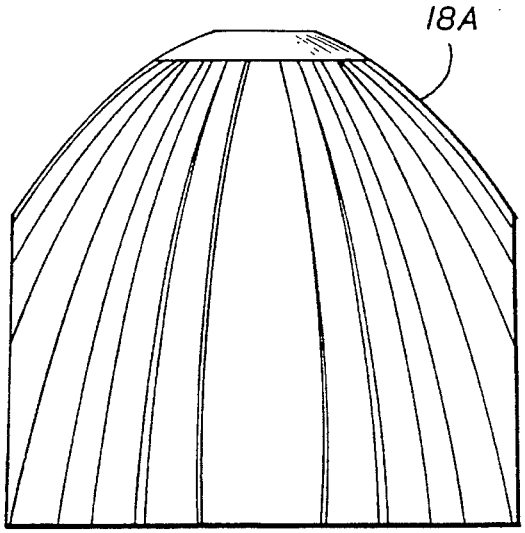
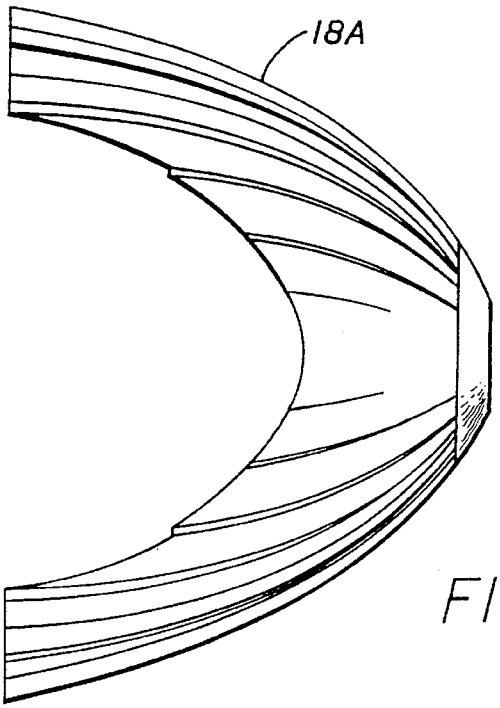
FIG. 8

ILLUMINATION SYSTEM INCLUDING AN ASYMMETRICAL PROJECTION REFLECTOR

BACKGROUND OF THE INVENTION

The present invention relates to an illumination system which includes an improved asymmetrical substantially ellipsoidal converging projection reflector for use in conjunction with an extended light source in a light projection system, such as a liquid crystal display system, motion picture projection system, automobile headlights, and the like.

One type of a conventional converging reflector is formed by a reflecting mirror of paraboloid shape in which a light source is positioned at the focal point of the paraboloid, and in which the reflector serves to reflect light from the light source to form a parallel light beam of a circular cross section. Another type of a conventional converging reflector is formed by a reflecting mirror of an ellipsoid shape in which a light source is positioned at a first focal point of the ellipsoid to permit light from the light source to converge into a second focal point by means of an ellipsoid reflector, with the reflected light from the reflecting mirror being changed into a parallel circular light beam by a condenser lens whose focal point is coincident with the second focal point.

Light projection and display systems using conventional reflectors of the type described in the preceding paragraph are generally inefficient when used in conjunction with projection and display systems which have non-circular apertures. This is because the light beam projected therefrom has a generally circular cross section. Accordingly, when such reflectors are used, for example, in a liquid crystal display system, or in a motion picture projection system, only a portion of the circular light beam illuminates the area within the aperture associated with the liquid crystal display light valve which is usually rectangular in shape, with the light outside the aperture being lost.

Display systems utilizing a liquid crystal light valve are usable in a variety of applications such as computers, video projectors and television. A display system of this type may include a liquid crystal light valve, an illumination system for providing light to the light valve, and projection optics for receiving light from the liquid crystal light valve and projecting the light toward a projection surface, such as a screen. As explained above, the liquid crystal light valve in such a display systems usually has a rectangular aperture. The reflector of the present invention finds particular utility in such liquid crystal light valve display systems for use in the illumination system of the light valve, and to assure that most of the light generated by the illumination system passes through the rectangular aperture and is directed across the entire area within the rectangular aperture with uniform illumination.

Attempts have been made in the past to produce an illuminating flux in liquid crystal display systems which has a rectangular cross section. U.S. Pat. No. 5,142,387, for example, discloses a projection type display device having a light source emitting a parallel luminous flux, and a liquid crystal display panel positioned in the luminous flux having a rectangular configuration for projecting a rectangular two-dimensional image onto a screen. The light source has a first concave parabolic mirror whose reflective surface is oriented in the direction of emission of the luminous flux, a lamp placed in front of the first concave mirror; and a second concave parabolic or spherical mirror, the reflective surface of which is oriented toward the first concave mirror. An aperture window is formed in the second concave mirror which has a rectangular configuration of the same size as the rectangular configuration of the liquid crystal display panel, and which emits a rectangular luminous flux. The beam of the lamp is reflected by the first concave mirror, and one or more times by the second concave mirror, resulting in a parallel beam oriented in the direction of the optical axis. The parallel beam is formed into a luminous flux of rectangular cross section by the rectangular window aperture in the second concave mirror.

Likewise, U.S. Pat. No. 5,123,729 discloses projection apparatus which includes an optical system that converts light emitted from a light source into substantially parallel light rays in a luminous flux directed at a liquid crystal display panel. The optical system in this patent converts the light into a luminous flux having a rectangular cross section of essentially the same size as the liquid crystal display panel. The optical system of the patent includes a plurality of parabolic mirror sections having foci substantially coincident with the position of the light source.

U.S. Pat. No. 5,123,729 deals mostly with the recognition that an LCD has an optimum contrast ratio at some angle of incidence, and the incident angle range over which high contrast is produced is very small in one axis and quite large in the other. The patent offers some reflector designs and refractive elements that can be used to maintain control over the incident angle with respect to the LCD panel, especially in the vertical axis.

The primary object of the present invention is to provide an improved illumination system which is more efficient than the prior art systems, provides increased control over the uniformity of projected light, and which provides increased angular distribution of the light.

A more specific object of the invention is to provide an illumination system which includes an asymmetrical projection reflector which is constructed to match the output luminous flux cross section of the reflector with a non-circular aperture, which improves efficiency, and furthermore which allows greater control over uniformity of the light incident at the aperture. The reflector of the present invention is not limited to LCD projection systems, although it does offer advantages for LCD projection systems since the LCD aperture is usually rectangular. The present invention does, however, have an added advantage for LCD projection in that greater control over incident angle can be achieved with a surface-of-revolution feature incorporated into the reflector.

Another object of the present invention is to provide a more efficient reflector for illuminating non-circular apertures, such as rectangular apertures, which are common in applications such as liquid crystal display systems or motion picture projection systems, automobile headlamps, and the like. The reflector of the present invention is more efficient than the prior art reflectors because it allows for the production of a luminous flux cross-section that substantially matches the aperture to be illuminated.

Yet another object of the present invention is to provide more control over the uniformity of light intensity at the illuminated aperture than is possible with prior art reflectors. The reflector of the invention uses specially tilted and rotated surfaces, segments and/or other elements to direct some of the light from the light source into aperture regions outside an inscribed circular area.

Conventional circularly symmetric reflectors also tend to create an unavoidable hot spot at the center of the projected image. This hot spot is due to the overlapping images of the light source at the second focus that the circularly symmetric reflector creates, and these images all cross at the optical axis. The sum of all the images combined produces a greater intensity of luminous flux where it crosses at the center. Even the apparatus taught in U.S. Pat. No. 5,123,729 suffers from this effect, since all the parabolic sections share a common optical axis. The present invention eliminates this hot spot by shifting, via tilting and rotating of each reflector section, the image of the light source away from the optical axis. The present invention thus allows greater control over uniformity of luminous flux intensity at the projected image.

In a first embodiment of the invention all of the segments of the reflector are formed from a single circularly symmetrical shape, such as an ellipsoid. The resulting identical reflector segments are then tilted and rotated appropriately so as to direct light into the corner regions of the aperture outside the inscribed circular area. The reflector design of this embodiment is particularly suited to motion picture theater projection applications in which the aperture to be illuminated is relatively far away from the light source. The use of such identical reflector segments greatly simplifies fabrication of the tooling for manufacturing the reflector surface. In a second embodiment the reflector segments are not identical, and the reflector is particularly useful in projection systems in which the light source is relatively close to the aperture, such as in liquid crystal display systems.

The possibility of using a liquid crystal display in a video display system, including projection television, is well accepted, and several such systems have been proposed. In an article on pages 375–377 of the 1986 issue of *Society of Information Display Digest*, Seiko Epson Corporation discloses a projection system including an illumination subsystem, a modulating device in the path of light emitted from the illumination subsystem, and a projection lens for projecting the image of the modulating device. More specifically, and as described in U.S. Pat. No. 4,912,614, an illumination subsystem is provided in the form of a halogen lamp and a spherical reflector for projecting light through a condenser lens to a pair of dichroic mirrors which split the light into its red, blue and green components. Each beam component impinges a respective modulating device in the form of a liquid crystal display (LCD) light valve. A dichroic prism combines the three monochromatic images into a single color image which the projection lens projects onto a screen. The article states that the system offers the advantages of compactness, low cost and brightness. Despite the latter claim, the overall light collection efficiency of the system is still less than 1%. This low efficiency is largely due to the fact that only a small percentage of the light rays is collected and directed toward the aperture of the liquid crystal panel, toward the entrance pupil of the projection lens. Furthermore, when either a parabolic reflector or a refractive lens condensing system is used with a rectangular light valve, such as an LCD, the "fill factor" further diminishes efficiency. For example, for an LCD having 4:3 aspect ratio, only 61% of a circumscribing circle representing the light beam is filled by the LCD.

From the foregoing it is apparent that it would be desirable to have a more highly efficient illumination system, that is, a system that focuses a greater amount of lumens radiated from the light source into the rectangular aperture area, corresponding to the active area of the LCD. Furthermore, it is desirable to have a 100% fill of the rectangular aperture, with substantially even luminous flux intensity across the entire aperture.

The reflector of the present invention overcomes the problems discussed above by matching the luminous flux cross section from the reflector to the shape of the output aperture, such as the active area of the LCD or a film gate. Furthermore, the present invention allows control over the uniformity of luminous flux incident at the output aperture. The present invention accomplishes this by breaking a circularly symmetric reflector into a plurality of segments, and rotating and/or tilting each segment to produce the desired image shape.

As mentioned above, the second embodiment of the invention in which the reflector segments are not identical is particularly useful in applications where the light source is relatively close to the output aperture, such as usually is the case in LCD projection systems. This type of reflector allows even better control of uniformity at the output aperture, and allows for additional control of the incident angle of the light with respect to the output aperture.

Both embodiments of the invention may be constructed where the curved reflecting surface of each segment may be replaced with small flat sections, where the center of each flat section is coincident with the primary reflecting curved surface. These flat sections tend to further integrate the luminous flux incident at the output aperture, which further improves uniformity, and are especially useful with complex light sources, such as tungsten, halogen, lamps.

As is well known, a liquid crystal display (LCD) panel produces maximum contrast for light that is incident on the LCD at some ideal angle, typically 0–15 degrees from normal. Contrast is the ratio of the transmission of light through the LCD during its on state to the ratio of transmission through the LCD during its off state. Therefore, if luminous flux is allowed to pass through the LCD at angles significantly different from the ideal angle, transmission of the LCD during its off state will increase, resulting in poor contrast.

As mentioned above, an objective of the present invention is to provide an illumination source which not only produces luminous flux with a rectangular cross section at the LCD plane and provides control of flux uniformity at the LCD plane, but also provides for control over the incident angle with respect to the liquid crystal display panel to overcome the problems discussed above, that is, maximizing the contrast of the system.

BRIEF DESCRIPTION OF THE DRAWINGS

FIG. 1 is a schematic representation of the illumination of a rectangular aperture by luminous flux of circular cross section in a conventional projection system;

FIG. 2 is a schematic representation of the illumination of the rectangular aperture in the conventional projection system by a circular luminous flux of reduced diameter which is completely contained within the aperture;

FIG. 3 is a schematic representation useful in explaining the operation of the reflector of the invention;

FIG. 4 is another schematic front view of the reflector of the first embodiment of the invention;

FIG. 5 is a side view of the reflector of FIG. 4;

FIG. 6 is a front view of the reflector of the invention in accordance with a second embodiment;

FIG. 7 is a side view of the reflector of the embodiment of FIG. 6; and

FIG. 8 is a side view, like FIG. 7, but with the reflector turned 90 degrees about its longitudinal axis.

DETAILED DESCRIPTION OF THE ILLUSTRATED EMBODIMENTS

Conventional light source condensing reflectors used in conjunction with a liquid crystal display, motion picture and other projection systems, as described above, are inefficient because they illuminate a circular region designated 10 in FIG. 1 at the output aperture whereas the aperture itself is usually rectangular in shape, as designated 12, with the light outside the aperture being lost.

The reflector of the present invention employs tilted and rotated segments, as will be described, to direct some of the light collected from the source into aperture regions outside of an inscribed circular area 14 of the luminous flux within the aperture 12, as shown in FIG. 2, so that the entire area circumscribed by the aperture is uniformly illuminated.

The operation of the reflector of the invention in illuminating the rectangular aperture of the liquid crystal light valve can be best understood by reference to FIG. 3. A circularly symmetrical reference reflector segment surface 18 is shown collecting light from an extended light source "a" such as an arc lamp or tungsten filament lamp. The collected light from the reference segment surface 18 is directed toward the aperture 12. FIG. 3 shows an on-axis ray from the source "a" being reflected from point "b" on the reference reflector surface to a point "c" at the center of the aperture. In the illustrated embodiment, the reference surface element at "b" is tilted through an angle $\alpha$ and rotated through an angle $\beta$ with respect to the reference surface by the tilting and rotation of segment 16 so that the normal axis N of the reference surface segment is moved to N' and the reflected ray is deflected to the corner of the aperture 12 at c'.

In the construction of the complete reflector surface of the reflector of FIG. 3 the various surface elements such as b are tilted and rotated with respect to the corresponding reference surface appropriately to direct some of the collected light toward the corner regions of the aperture 12. The light is also further reflected in such a manner as to produce uniform illumination of the aperture 12. The construction of the reflector requires the use of suitable computer software to evaluate illumination uniformity. In the embodiment of the invention shown in FIGS. 4 and 5, all of the segments of the reflector are formed from a single circularly symmetric shape, such as an ellipsoid. The several identical reflector segments, such as segment 16, are then tilted and rotated appropriately with respect to the reference surface so as to direct light into the corner regions of the aperture, as shown by the arrows in FIG. 2.

In the first embodiment of the invention the reflector segments 16*a*-16*v*, as shown in FIGS. 4 and 5 are all derived from a single circular symmetrical reference surface 18 of approximately ellipsoid form. The reference surface segments are then tilted and rotated as described in conjunction with FIG. 3 to produce uniform illumination of the rectangular aperture. As shown in the front view of FIG. 4, the segments do not have to encompass equal angular sectors. Although the segments may be derived from a single ellipsoid of revolution, the preferred embodiment of the invention employs multiple segmented sections to be described in conjunction with FIGS. 6–8.

The reflector of the preferred embodiment, as shown in FIGS. 8, 9 and 10, has an additional design freedom of permitting all of the reflector segments to have substantially different profiles. Accordingly, each such reflector segment may be individually designed using the principles described in conjunction with FIG. 5. As stated above, the second embodiment is useful when the lamp source is relatively close to the aperture 12. The type of reflector shown in FIGS. 8, 9 and 10 and designated 18A, permits better control of the uniformity of aperture illumination, and it also permits control of the incidence angle for liquid crystal display applications. This enables optimum light to be provided to the liquid crystal display panel while maintaining the desired high contrast ratio and achieving essentially uniform light intensity distribution at the panel.

It will be appreciated that while particular embodiments of the invention have been shown and described, modifications may be made. It is intended in the following claims to cover all such modifications which fall within the true spirit and scope of the invention.

I claim:

1. An illumination system including a non-circular aperture, a light source, and a projector reflector, all displaced from one another along an optical axis, said reflector being constructed to match the cross-section of the output luminous flux from the reflector with the non-circular aperture, said reflector having a reflective surface formed of a plurality of reflective segments individually tilted and rotated with respect to a reference surface by respective predetermined amounts to shift light from said source away from the optical axis and into selected regions of said aperture to cause the entire area circumscribed by said aperture to be uniformly illuminated.

2. The illumination system defined in claim 1, in which said surface segments are all formed to have a single circularly symmetric shape.

3. The illumination system defined in claim 2, in which said circularly symmetric shape is substantially ellipsoidal.

4. The illumination system defined in claim 2, in which said segments are all of a single surface of revolution.

5. The illumination system defined in claim 1, in which said segments are all derived from a single circularly symmetrical surface of substantially ellipsoidal form.

6. The illumination system defined in claim 5, in which said segments encompass unequal angular segments.

7. The illumination system defined in claim 1, in which said reflection surface segments each has a substantially different profile.

8. The illumination system defined in claim 1 in which said concave reflection surface comprises a plurality of flat sections.

9. The illumination system defined in claim 1, in which said aperture has a rectangular configuration with corner regions and in which said reflector directs light from said luminous flux away from said optical axis and into said corner regions.

* * * * *